US006499608B1

(12) United States Patent
Sterling et al.

(10) Patent No.: US 6,499,608 B1
(45) Date of Patent: Dec. 31, 2002

(54) WALL-MOUNTED STORAGE SYSTEM

(75) Inventors: John R. Sterling, Woodstock, IL (US); Richard G. Kluge, Lake Geneva, WI (US)

(73) Assignee: John Sterling Corporation, Richmond, IL (US)

( * ) Notice: Subject to any disclaimer, the term of this patent is extended or adjusted under 35 U.S.C. 154(b) by 0 days.

(21) Appl. No.: 09/503,426

(22) Filed: Feb. 14, 2000

(51) Int. Cl.[7] ..... A47F 7/00
(52) U.S. Cl. ..... 211/70.6; 211/70.1
(58) Field of Search ..... 211/70.6, 90.01, 211/90.02, 90.034, 69, 71.01, 70.1; D6/553

(56) References Cited

U.S. PATENT DOCUMENTS

| | | | | |
|---|---|---|---|---|
| 2,400,807 A | * | 5/1946 | Burkhard | 211/87.01 |
| 2,622,834 A | | 12/1952 | Sparring | |
| 2,805,777 A | * | 9/1957 | Larson | 211/70.6 |
| 2,974,804 A | * | 3/1961 | Maro | 211/70.6 |
| 3,015,466 A | | 1/1962 | Levy | |
| 3,184,068 A | | 5/1965 | Wende | |

(List continued on next page.)

FOREIGN PATENT DOCUMENTS

GB 1444525 8/1976

OTHER PUBLICATIONS

Search Report to British Patent Office dated Mar. 28, 2001 for application GB 0102445.4.
Advertising Slick: Heavy Duty Wall Organizer Value Pack, Model RP–0024, 2 pages, Form No. RP24–SI, John Sterling Corporation, Copyright 1991.
Advertising Slick: Home Storage & Organization, John Sterling Corporation, Form ORGI–SL, Copyright 1997.

*Primary Examiner*—Daniel P. Stodola
*Assistant Examiner*—Khoa Tran
(74) *Attorney, Agent, or Firm*—Wood, Phillips, Katz, Clark & Mortimer

(57) ABSTRACT

A wall-mounted storage system comprises a generally elongated mounting channel having upper and lower rows or hook-receiving openings defined thereby. The system further includes a plurality of storage attachments which are selectively removably positionable on the mounting channel. Each of the attachments includes at least one pair of vertically-spaced, downwardly opening hook-elements. Each pair of hook-elements can be selectively positioned in a respective pair of vertically aligned ones of the hook-receiving openings in the mounting channel, with the variously configured storage attachments providing a highly versatile and easily customized storage system.

23 Claims, 10 Drawing Sheets

U.S. PATENT DOCUMENTS 3,220,363 A 11/1965 Gingher
3,353,684 A 11/1967 Chesley
3,358,956 A 12/1967 Thornton
3,631,821 A 1/1972 Zachariou
3,895,774 A 7/1975 Sharp
3,901,611 A * 8/1975 Simonsen ..... 403/187
4,018,167 A * 4/1977 Spangler ..... 108/152
4,029,282 A * 6/1977 Dauth ..... 248/221.1
4,138,019 A 2/1979 Smith
4,198,913 A * 4/1980 Haworth et al. ..... 108/108
4,244,637 A 1/1981 Boorman, Jr.
4,341,486 A * 7/1982 Hammerschlag ..... 403/252
4,345,688 A 8/1982 De Boer
4,779,830 A 10/1988 Phelps
4,805,863 A 2/1989 Armstrong et al.
5,110,080 A 5/1992 Rieman
5,143,228 A 9/1992 Arnold
5,185,971 A 2/1993 Johnson, Jr.
5,379,976 A 1/1995 DeGirolamo
5,392,934 A 2/1995 Fox
5,419,443 A 5/1995 Niederberger et al.
D360,328 S * 7/1995 Greenlee ..... D6/569
5,454,638 A * 10/1995 Bird et al. ..... 312/408
5,472,103 A * 12/1995 Merl ..... 211/187
5,485,932 A 1/1996 Romm et al.
5,531,415 A 7/1996 Kallemeyn
5,535,882 A * 7/1996 Liu ..... 206/377
5,641,079 A 6/1997 Schmidt
5,743,416 A 4/1998 Yemini
5,769,520 A * 6/1998 Jun et al. ..... 312/408
5,803,274 A 9/1998 Scheveloff
5,899,035 A * 5/1999 Waalkes et al. ..... 52/239
6,101,773 A * 8/2000 Chau et al. ..... 52/220.7
6,135,584 A * 10/2000 Happ ..... 312/330.1
D438,448 S * 3/2001 Batting et al. ..... D8/354
D442,814 S * 5/2001 Sterling et al. ..... D6/553
D446,710 S * 8/2001 Sterling et al. ..... D8/354

* cited by examiner

WALL-MOUNTED STORAGE SYSTEM

TECHNICAL FIELD

The present invention relates generally to storage racks and like devices for holding tools, gardening implements, and other articles, and more particularly to a wall-mounted storage system which includes a mounting channel, and a variety of different attachments which can be selectively secured to the mounting channel to customize the storage system for holding a wide variety of different articles.

BACKGROUND OF THE INVENTION

Various types of storage arrangements are known in the prior art for storing tools, gardening implements, recreational equipment, and like articles on a wall or other mounting surface. Such arrangements may include hooks or racks which are secured to the wall, such as with suitable mechanical fasteners. The use of so-called pegboard, comprising an array of holes into which hooks or other racks can be selectively mounted, is also known, with this arrangement permitting the removable hooks or like support elements to be positioned as desired for the particular articles to be stored.

Unfortunately, storage devices such as noted above do not always provide sufficiently secure and versatile storage of articles. Because articles to be stored may vary greatly in size and weight, not all racks or hooks can be readily employed for a wide variety of articles. In the case of pegboard storage arrangements, the typical hooks or racks which are mounted in the board are generally secured therein under the influence of gravity, and can be easily dislodged, thus detracting from convenient and secure use.

It is therefore desirable to provide a storage arrangement for articles which is versatile in use, while still providing convenient, yet secure adjustment for different types of articles.

SUMMARY OF THE INVENTION

A wall-mounted storage system embodying the principles of the present invention has been particularly configured for highly versatile and convenient use by consumers, while permitting secure and stable interengagement of the components of the system. The system comprises a wall-mounted mounting channel which can be conveniently and securely mounted in a garage, workshop, closet, or other area where articles are stored. The system further includes a variety of differently configured storage attachments which can be selectively removably mounted on the mounting channel. The various attachments permit the present system to be readily configured for holding and storing a wide variety of differently sized and shaped articles. Notably, the system is specifically configured to permit the various attachments to be securely, yet removably, mounted on the mounting channel. A highly versatile, yet stable, storage system is thus provided.

In accordance with the illustrated embodiment, the present storage system includes an elongated mounting channel having a generally U-shaped cross-section, including upper and lower leg portions, and a forwardly facing web portion extending between the leg portions. The web portion defines upper and lower rows of laterally spaced, hook-receiving openings, with each of the hook-receiving openings being generally vertically elongated. Respective ones of the openings of the upper and lower rows are vertically aligned with each other to facilitate selective mounting of various storage attachments thereon.

The system further includes a plurality of storage attachments which are selectively, removably positionable on the mounting channel. Each of the attachments includes at least one pair of vertically-spaced, downwardly opening hook-elements. Each of the hook-elements defines an upwardly converging opening, whereby each pair of the hook-elements of each of the attachments can be selectively positioned in a respective pair of vertically aligned ones of the hook-receiving openings in the upper and lower rows of openings in the mounting channel.

Highly stable and secure mounting of the storage attachments on the mounting channel is achieved by configuring each of the hook-elements to resiliently receive the web portion of the mounting rail which is positioned beneath the respective one of the hook-receiving openings. Resilient deformation of the web portion acts to secure each of the storage attachments to the mounting channel, yet permits each of the storage attachments to be removed from the channel as may be required.

Versatility of the present system is enhanced by providing at least the upper leg portion of the mounting channel with a plurality of laterally spaced, article receiving openings. Preferably, both the upper and lower leg portions of the mounting channel define a plurality of laterally spaced openings, thus permitting insertion of tools, or other articles through the mounting channel for storage in addition to that provided by the storage attachments.

The present invention contemplates the provision of a wide variety of different storage attachments. One form of attachment comprises an outwardly extending rack extension. This type of attachment comprises a vertical plate portion having one of the pairs of vertically-spaced hook-elements at the rear thereof, and a horizontal plate portion extending from the vertical plate portion. The horizontal plate portion defines a plurality of spaced apart openings for receiving articles therein. In one illustrated embodiment of the rack extension, the extension includes a laterally spaced pair of the vertical plate portions, with the horizontal plate portion extending therebetween. The vertical plate portions each define a plurality of spaced apart, hook-like article-receiving openings, thus permitting a set of wrenches, for example, to be carried by the rack extension.

Other ones of the attachments comprise one-piece (i.e., unitary) storage compartments which comprise a pair of laterally spaced sidewalls, each of which include a pair of the vertically-spaced hook-elements at the rear thereof. These compartments comprise a floor extending integrally between the side walls, and front and rear walls extending integrally from the floor.

Another one of the attachments is provided in the form of a shelf support bracket, comprising a vertical plate portion having the pair of vertically-spaced hook-elements at the rear thereof. The vertical plate portion includes upper and lower rearward extensions respectively positioned above and below the hook-elements for respective positioning above and below the mounting channel when the shelf support bracket is mounted thereon. The shelf support bracket further includes a horizontal support flange at an upper edge of the vertical plate portion. By this configuration, an associated shelf member can be positioned on top of the horizontal flanges of a laterally spaced pair of the shelf support brackets when the brackets are mounted on the mounting channel.

A number of the attachments comprise a generally U-shaped mounting portion having a pair of laterally spaced side legs, each of which has a pair of the vertically spaced hook-elements at the rear thereof. These attachments provide highly secure and stable mounting on the mounting channel, by virtue of each having two pairs of the hook-elements. One of these attachments comprises a magnetic mounting element secured at the front of the U-shaped mounting portion, while other ones comprise a support rod extending outwardly from between the side legs of the mounting portion. In one embodiment, vertically spaced, upper and lower U-shaped support rods respectively extend outwardly from above and below the U-shaped mounting portion, with the U-shaped support rods thus configured to receive a power tool or like article.

Other embodiments of the attachments include a rear plate portion having a pair of vertically spaced hook-elements at the rear thereof. These attachments include a support arm which extends outwardly from the rear plate portion for receiving an article to be stored. In one embodiment, the support arm of the attachment is configured to receive an elongated article, such as a fishing rod, with the present system including a support tray positionable beneath the mounting channel to support the lower end of the elongated article.

Other features and advantages of the present invention will become readily apparent from the following detailed description, the accompanying drawings, and the appended claims.

BRIEF DESCRIPTION OF THE DRAWINGS

FIG. 23 illustrates an attachment including a pair of vertically spaced U-shaped support rods which are configured to receive a power tool or the like.

DETAILED DESCRIPTION

Figure 1:
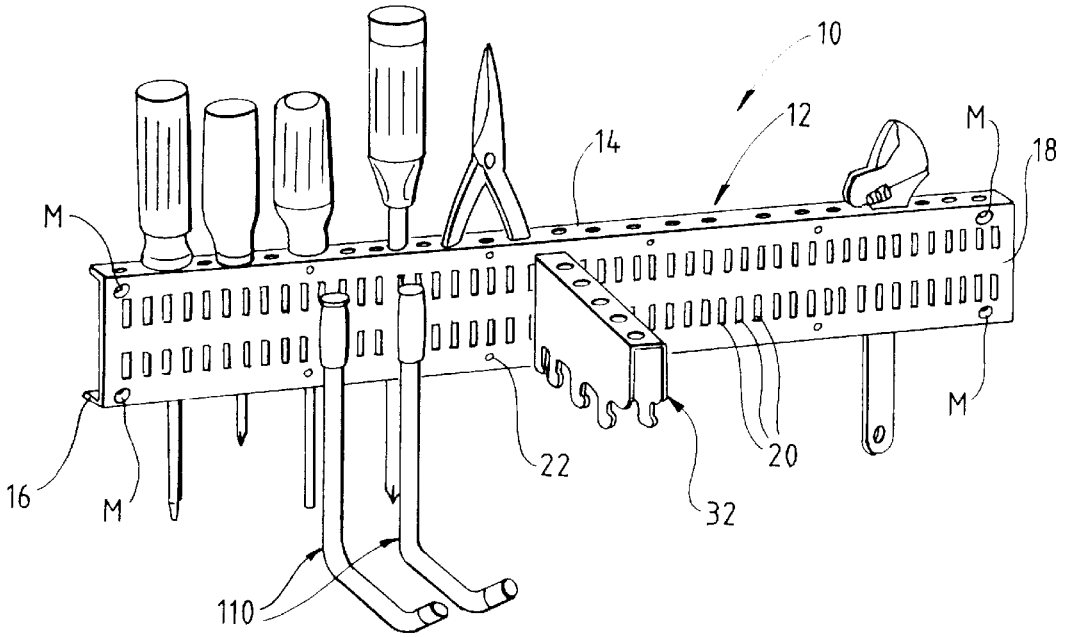
FIG. 1 is a perspective view of a wall-mounted storage system embodying the principles of the present invention, illustrating the system with various associated tools mounted thereon.

While the present invention is susceptible of embodiment in various forms, there is shown in the drawings and will hereinafter be described, presently preferred embodiments, with the understanding that the present disclosure is to be considered as an exemplification of the invention, and is not intended to limit the invention to the specific embodiments illustrated.

With reference first to FIG. 1, therein is illustrated a wall-mounted storage system 10 embodying the principles of the present invention. As will be further described, the present storage system includes an elongated mounting channel 12 having a generally U-shaped cross-section, and a plurality of variously configured storage attachments, as will be described, which are configured for selective, removable positioning on the mounting channel 12. The arrangement facilitates highly versatile and secure mounting of tools, such as illustrated, or like articles, in a wide variety of combinations and configurations, thus permitting convenient customization by home owners and like consumers.

Figure 2:
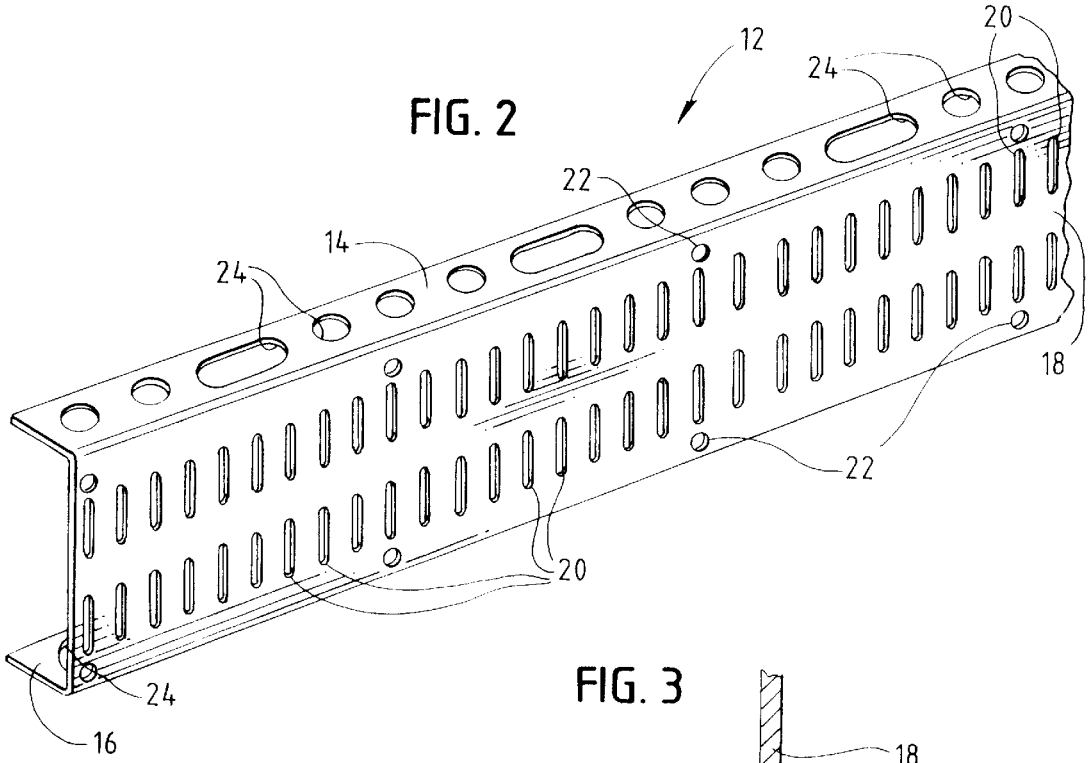
FIG. 2 is a perspective view of a mounting channel of the present storage system.

With particular reference to FIG. 2, the mounting channel 12 of the present system is illustrated. By virtue of its generally U-shaped configuration, the mounting channel includes upper and lower leg portions 14 and 16, and a forwardly facing web portion 18 extending between the leg portions. The web portion defines upper and lower rows of laterally spaced, hook-receiving openings 20. As illustrated, each of the hook-receiving openings 20 is generally vertically elongated. As will be observed, respective ones of the openings of the upper and lower rows are vertically aligned with each other. As will be further described, the various attachments of the present storage system are selectively removably positionable in one or more vertically aligned pairs of the openings 20.

The mounting channel 12 preferably comprises metallic material for strength, such as-steel or the like. While the mounting channel is elongated, it will be appreciated that it can be employed in any of a variety of different lengths, such as 12 inches, 18 inches, 24 inches, etc.

As shown in FIG. 2, the forwardly facing web portion 18 of the mounting channel preferably defines a plurality of laterally spaced openings 22. These openings are configured to receive suitable mechanical fasteners M (FIG. 1) to facilitate secure and stable mounting of the channel 12 on an associated wall or like mounting surface.

Versatility of the present storage system is enhanced by the preferred provision of a plurality of laterally spaced article-receiving openings 24, on at least the upper leg portion 14 of the mounting channel. In the preferred form, a plurality of laterally spaced article-receiving openings 24 are provided in both the upper and lower leg portions 14 and 16 of the mounting channel, thus permitting tools or like articles to be inserted through the mounting channel, as illustrated in FIG. 1. As shown in FIG. 2, these article-receiving openings may be differently sized, thus accommodating storage of different types of articles.

Figure 3:
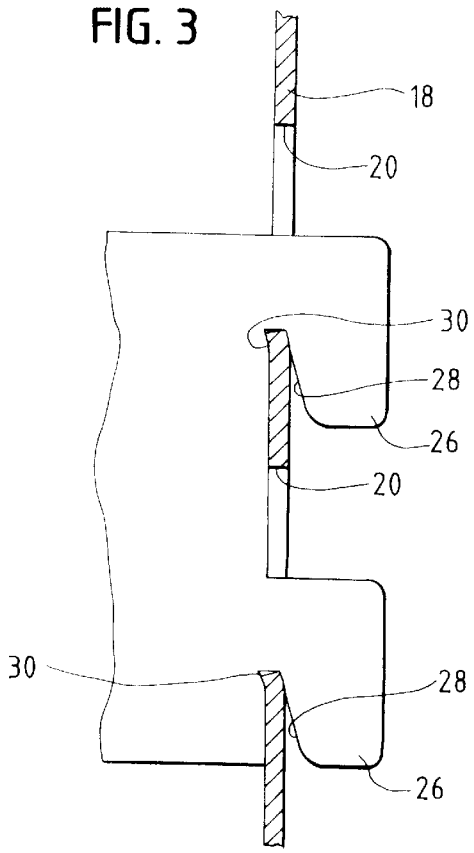
FIG. 3 is a fragmentary, cross-sectional view illustrating resilient interengagement of the vertically spaced hook-elements of the attachments of the present storage system with the mounting rail of the system illustrated in FIG. 2.

As noted above, the present storage system includes a plurality of different storage attachments which may be selectively positioned on the mounting channel 12 by cooperative interengagement with the hook-receiving openings 20 defined by the web portion of the mounting channel. FIG. 3 illustrates the arrangement by which the various attachments cooperate with the openings 20 to provide highly stable mounting of attachments on the mounting channel.

Each of the attachments of the present system which are configured for mounting into the openings 20 include at least one pair of downwardly opening hook-elements 26, as illustrated in FIG. 3. Hook-elements 26 of each attachment are preferably vertically spaced for providing the desired stability and cooperation with mounting channel 12, but a pair of laterally spaced hook-elements can be employed for certain ones of the storage attachments, if desired. Each of the hook-elements defines an upwardly converging opening 28, with each pair of hook-elements of each of the attachments being selectively positionable in a respective pair of vertically aligned ones of the hook-receiving openings 20 in the rows of openings in the mounting channel.

Each of the attachments of the present system is readily mountable on the channel 12 by insertion of the pair of hook-elements 26 through a vertically aligned pair of the openings 20. Movement of the attachment downwardly relative to the mounting channel causes the web portion 18 of the mounting channel to be received within the pair of openings 28 of the attachment. After such downward movement, the attachment is held in position on the mounting rail under the influence of gravity, and can be readily removed by simply moving the attachment upwardly and forwardly, whereby the hook-elements 26 are removed from the vertically aligned openings 20. However, in the event that more secure and stable mounting of the attachment is desired, the attachment may be urged downwardly, such as by tapping with a hammer or like implement, whereby the web portion of the mounting channel is resiliently deformed as it is received within the openings 28 defined by each of the hook-elements 26. This is illustrated in FIG. 3, wherein deformed portions 30 of the web portion 18 are illustrated as having been respectively received within the openings 28 of the illustrated attachment. While this cooperative interengagement of the attachments with the mounting channel is desirably secure, a like application of upward force to the attachment, such as with a hammer, nevertheless permits the attachment to be removed from the mounting channel, and repositioned as may be desired.

Various forms of the storage attachments of the present storage system will now be described.

Figure 4:
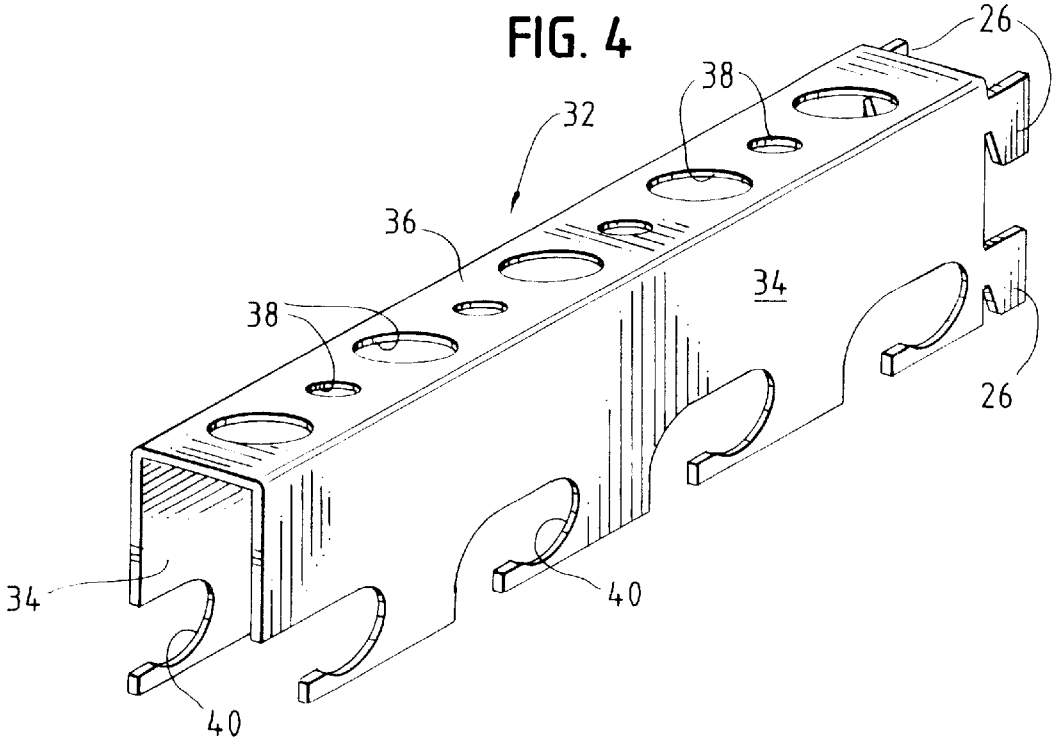
FIGS. 4 and 5 are perspective views of rack extensions which can be used in combination with the mounting channel of the present storage system.
Figure 5:
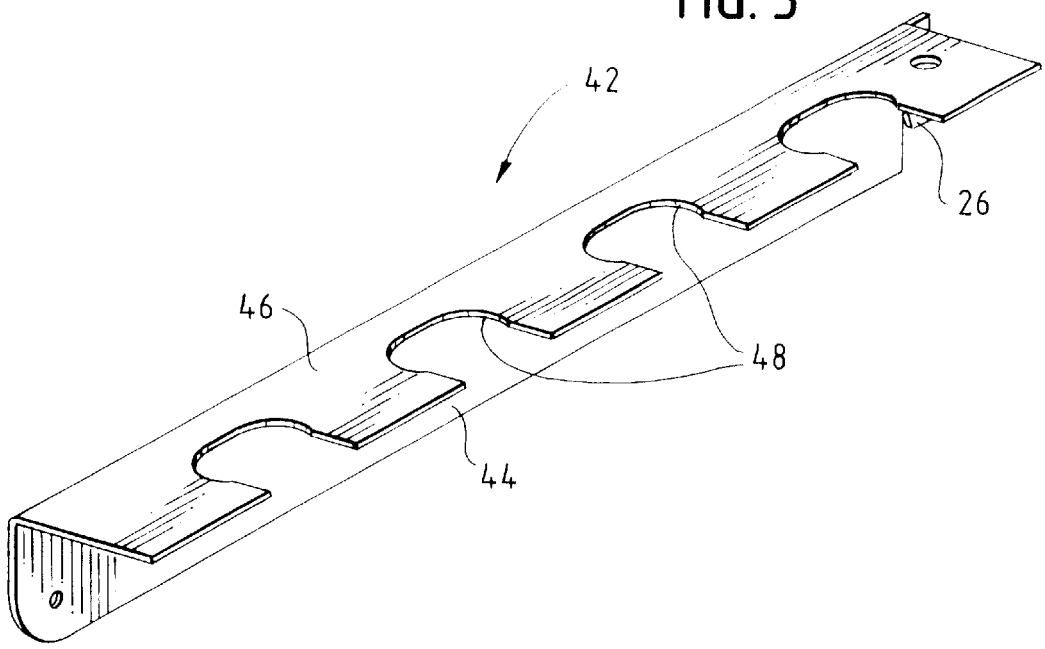

FIGS. 4 and 5 illustrate attachments for the present system which are provided in the form of rack extensions which extend outwardly from the mounting channel 12 of the present system. FIG. 4 illustrates a rack extension 32. The rack extension 32 includes a laterally spaced pair of vertical plate portions 34 each of which includes a pair of the vertically spaced hook-elements 26 at the rear thereof. The rack extension 32 further includes a horizontal plate portion 36 which extends between the vertical plate portions 34. The horizontal plate portion defines a plurality of spaced apart openings 38 for receiving articles therein, with the illustrated embodiment including differently sized openings for versatile use. Further versatility is achieved by the provision of a plurality of spaced apart article-receiving openings 40 defined by each of the vertical plate portions 34. In the illustrated embodiment, each of the openings 40 has a hook-like configuration, thus facilitating hanging of articles therefrom. The attachment 32 illustrated in FIG. 4 is particularly configured for holding a set of box-end wrenches, which can be conveniently hung from the hook-like openings 40 defined by the vertical plate portions 34.

An attachment in the form of another rack extension 42 is illustrated in FIG. 5. This rack extension includes a vertical plate portion 44 having a pair of vertically spaced hook-elements 26 (one partially shown) at the rear thereof. A horizontal plate portion 46 extends from the vertical plate portion, and defines a plurality of spaced apart openings 48 for receiving articles therein. These openings may be sized to receive articles such as sporting equipment, for example, baseball bats, hockey sticks, etc.

Figure 6:
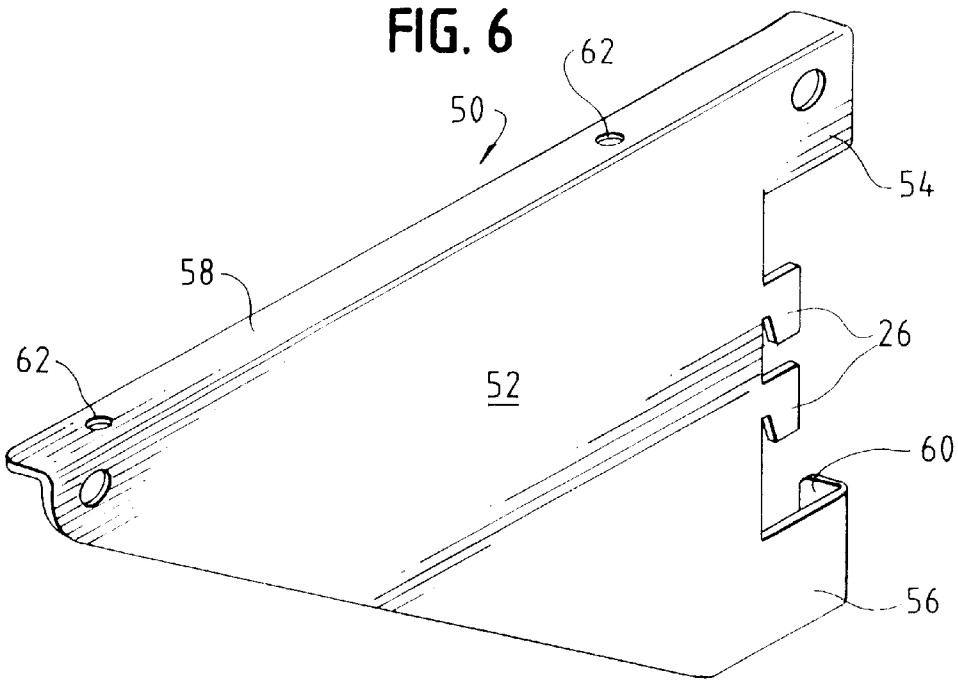
FIG. 6 is a perspective view of an attachment for the present storage system provided in the form of a shelf support bracket.
Figure 7:
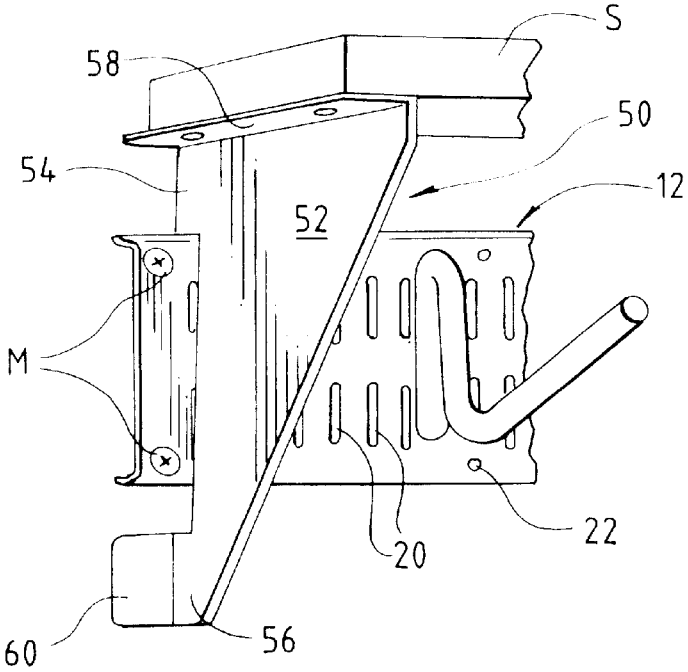
FIG. 7 is a fragmentary, perspective view illustrating the shelf support bracket of FIG. 6 in use.

Referring now to FIGS. 6 and 7, therein is illustrated an attachment in the form of a shelf support bracket 50 for the present storage system. The shelf support bracket 50 comprises a vertical plate portion 52 having a pair of vertically spaced hook-elements 26 at the rear thereof. Notably, the vertical plate portion includes upper and lower rearward extensions 54 and 56 which, as illustrated in FIG. 6, are respectively positioned above and below hook-elements 26. As best illustrated in FIG. 7, the upper and lower extensions are respectively positionable above and below the mounting channel 12 when the shelf support bracket is mounted on the mounting channel with hook-elements 26 in a vertically aligned pair of the hook-receiving openings 20.

The shelf support bracket 50 further includes a horizontal support flange 58 at an upper edge of vertical plate portion 52. By this arrangement, an associated shelf member S, illustrated in FIG. 7, can be positioned on top of the horizontal flanges 58 of a laterally spaced pair of the shelf support brackets 50 mounted on the mounting channel 12. Additional stability is provided by configuring lower extension 56 to include a wall-engaging tab 60, whereby loads carried by the shelf support bracket are directed not only into mounting channel 12, but directly to the associated wall or like structure on which the present storage system is mounted. Suitable openings 62 in horizontal support flange 58 facilitate securement of the shelf S to the support brackets.

Figure 8:
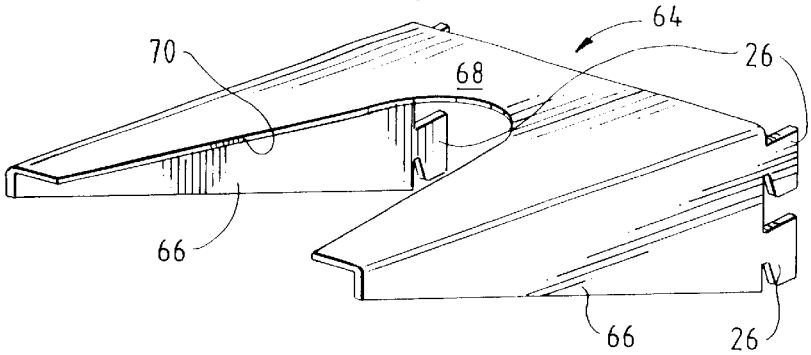
FIG. 8 illustrates an attachment of the present storage system in the form of a one-piece tool hanger.

FIG. 8 illustrates an attachment of the present storage system provided in the form of a one-piece tool hanger 64. The tool hanger 64 includes a pair of laterally spaced side plates 66 each of which has a pair of vertically spaced elements 26 at the rear thereof. The tool holder further includes an upper plate 68 extending integrally between the side plates 66. The upper plate 68 preferably defines a forwardly opening recess 70 for receiving an associated tool therein for mounting on the present storage system when the tool holder 64 is mounted on channel 12.

Figure 9:
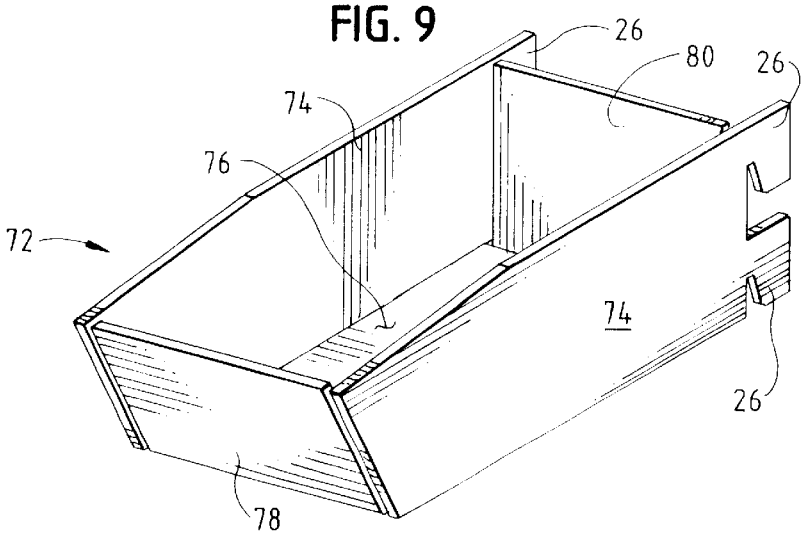
FIGS. 9 and 10 illustrate attachments in the form of tray-like, one-piece storage compartments.
Figure 10:
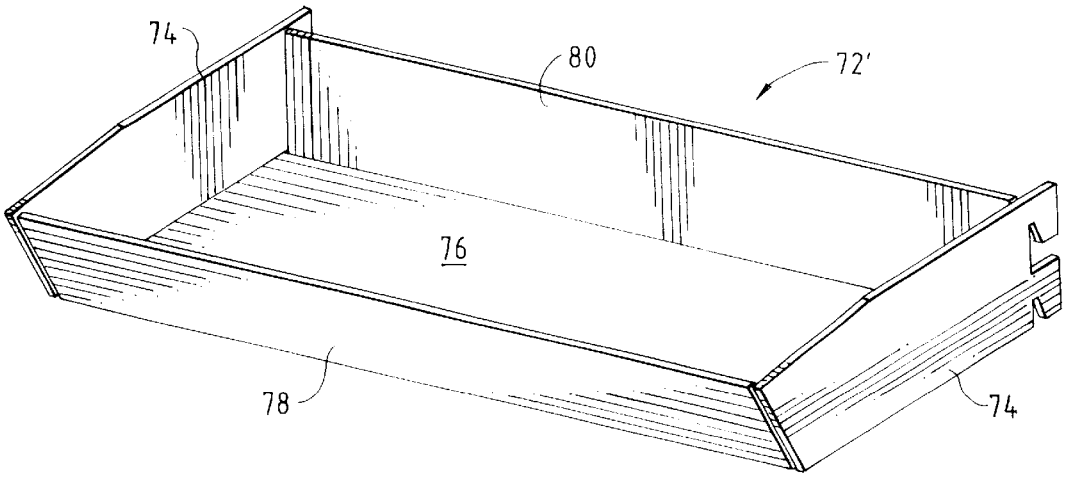

FIGS. 9 and 10 illustrate attachments for the present storage system in the form of one-piece storage compartments, respectively designated 72, 72'. While differently sized, the storage compartments 72, 72' are similarly unitarily configured, with each comprising a pair of laterally spaced side walls 74, which each include a pair of vertically spaced hook-elements 26 at the rear thereof. Each of the storage compartments further comprises a floor 76 extending integrally between the side walls 74. Each compartment also includes a front wall 78 extending integrally from the floor 76, and a rear wall 80 extending integrally from the floor 76.

Figure 11:
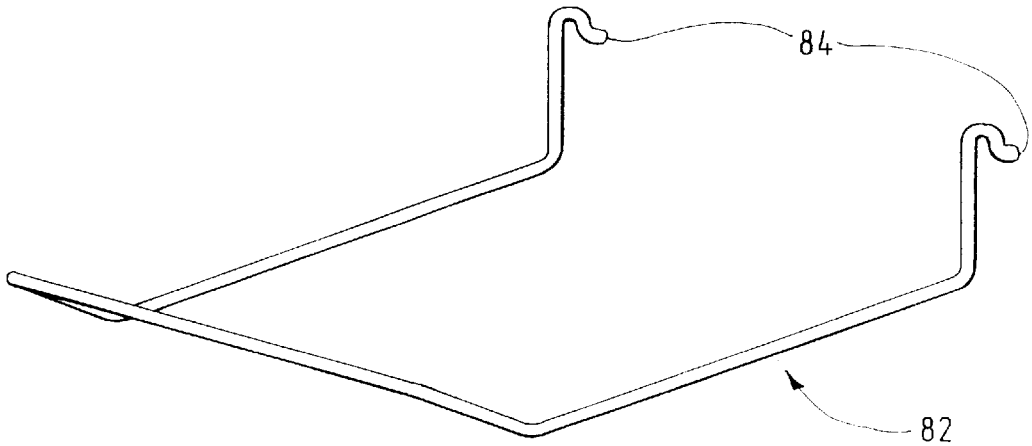
FIGS. 11 and 12 illustrate attachments in the form of generally U-shaped wire racks.
Figure 12:
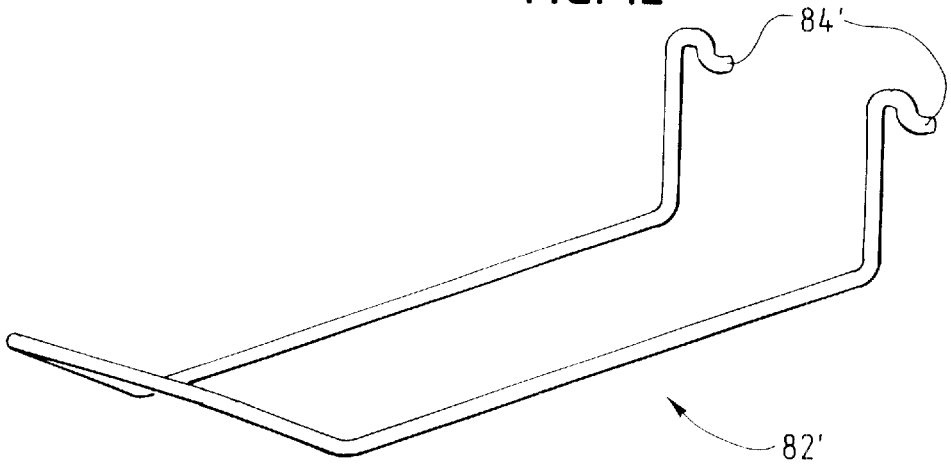

FIGS. 11 and 12 illustrate additional components of the present storage system which further enhance its versatile use. As noted above, the upper leg portion 14 of the mounting channel 12 defines a plurality of laterally spaced openings 24. FIGS. 11 and 12 illustrate generally U-shaped wire racks, respectively designated 82, 82', which are configured for removable mounting in a laterally spaced pair of the openings 24 of the mounting channel 12. In particular, each of the wire racks 82, 82' includes a pair of laterally spaced free ends at the rear thereof, respectively designated 84, 84' , with the spacing between the free ends of each of the wire racks corresponding to the spacing between a selected laterally spaced pair of the openings 24. It is contemplated that wire racks 82, 82' are particularly suited for holding sporting equipment such as balls or the like, with the rack 82 of FIG. 11 configured to hold one relatively large ball, while the rack 82' of FIG. 12 can hold a plurality of relatively smaller balls.

FIGS. 13 to 18 illustrate attachments for the present storage system, each of which is configured for interengagement with two pairs of the vertically aligned hook-receiving openings 20 in the web portion 18 of mounting channel 12. As such, each of these attachments provides highly secure and robust interengagement with the mounting channel and can thus support relatively heavy articles, as may be required. In particular, each of these attachments includes a generally U-shaped mounting portion having a pair of laterally spaced side legs, each of which has a pair of the vertically spaced hook-elements 26 at the rear thereof.

Figure 13:
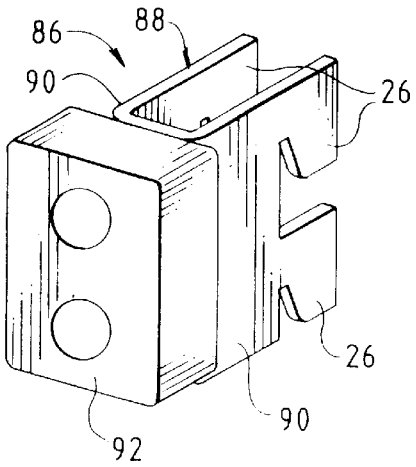
FIG. 13 illustrates an attachment including a magnetic mounting element.

With reference first to FIG. 13, the attachment 86 illustrated therein includes a generally U-shaped mounting portion 88 having a pair of laterally spaced side legs 90, each of which has a pair of vertically spaced hook-elements 26 at the rear thereof. The attachment 86 further includes a magnetic mounting element 92 secured to the front of the U-shaped mounting portion 88 with the magnetic mounting element including one or more suitable magnets whereby ferrous articles such as tools or the like can be conveniently removably positioned on the attachment.

Figure 14:
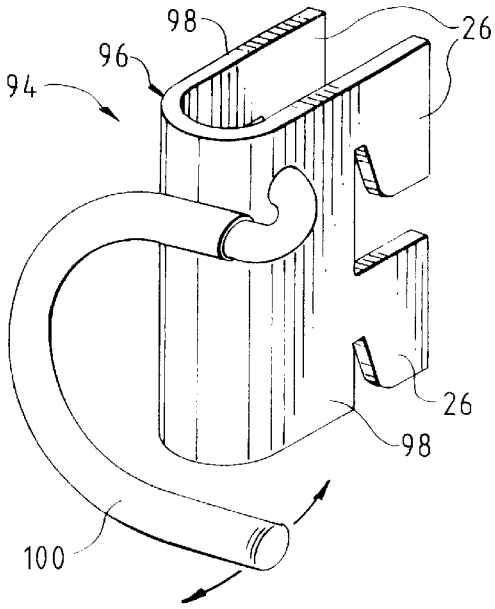
FIG. 14 illustrates an attachment including a pivotal U-shaped support rod.

FIG. 14 illustrates an attachment 94 having a generally U-shaped mounting portion 96 including a pair of laterally spaced side legs 98 each of which has a pair of vertically spaced hook-elements 26 at the rear thereof. The attachment 94 includes generally U-shaped support rod 100 pivotally attached to the U-shaped mounting portion 96. The U-shaped support rod is sized and configured to receive the elongated handle of a shovel, rake, or like implement.

Figure 15:
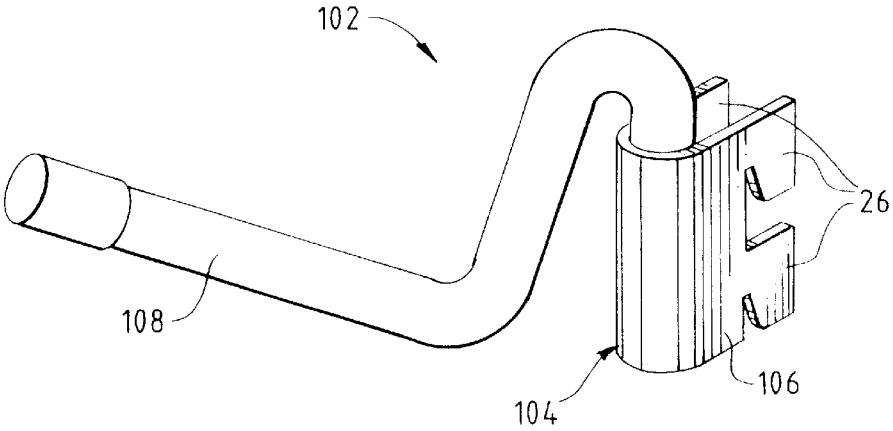
FIGS. 15 to 18 illustrate various configurations of attachments, each including a support rod extending outwardly from a U-shaped mounting portion.

The attachment 102 illustrated in FIG. 15 includes a U-shaped mounting portion 104 having a pair of laterally spaced side legs 106, each of which has a pair of vertically spaced hook-elements 26 at the rear thereof. A support rod 108 extends outwardly from between the side legs 106 of the U-shaped mounting portion 104, with this attachment including a support rod which extends generally angularly upwardly, such as for supporting a garden hose, extension cord, or the like.

Figure 16:
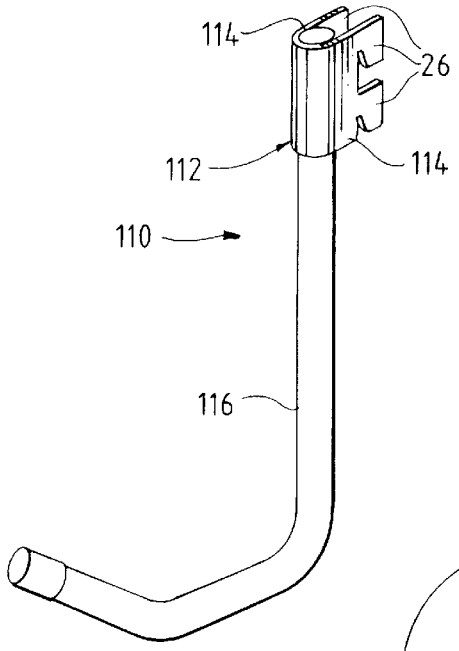

The attachment 110 illustrated in FIG. 16 also includes a generally U-shaped mounting portion, designated 112, having a pair of laterally spaced side legs 114, each of which has a pair of vertically spaced hook-elements 26 at the rear thereof. Attachment 110 includes a support rod 116 extending outwardly from between the side legs 114 with this attachment being configured for use by itself to support an article, or for use with a like attachment 110 for support of an article therebetween (note the pair of laterally spaced attachments 110 illustrated in FIG. 1).

Figure 17:
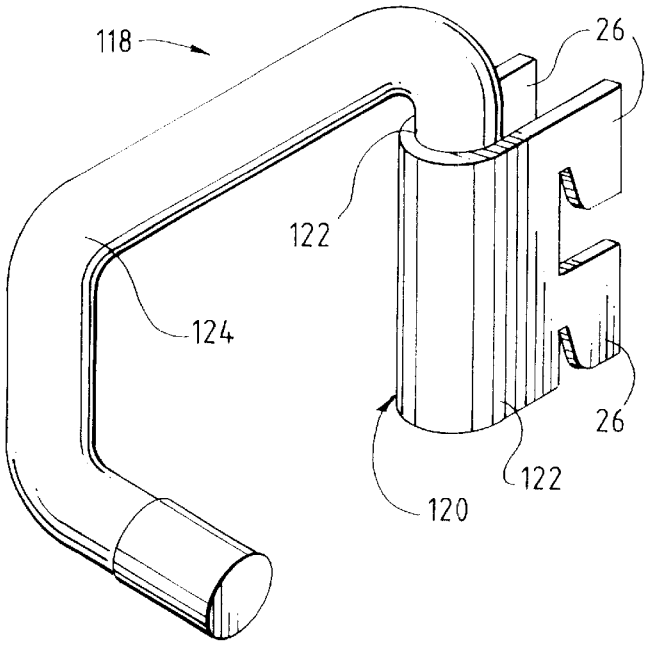

The attachment 118 illustrated in FIG. 17 includes a generally U-shaped mounting portion 120 having a pair of laterally spaced side legs 122, each of which has a pair of vertically spaced hook-elements 26 at the rear thereof. A support rod 124 extends outwardly from between the side legs 122 of the U-shaped mounting portion 120. This particular attachment is configured such that the support rod 124 extends outwardly, and then laterally, and can thus be fitted about the wheel of a bicycle, whereby the bicycle can be supported by the present storage system.

Figure 18:
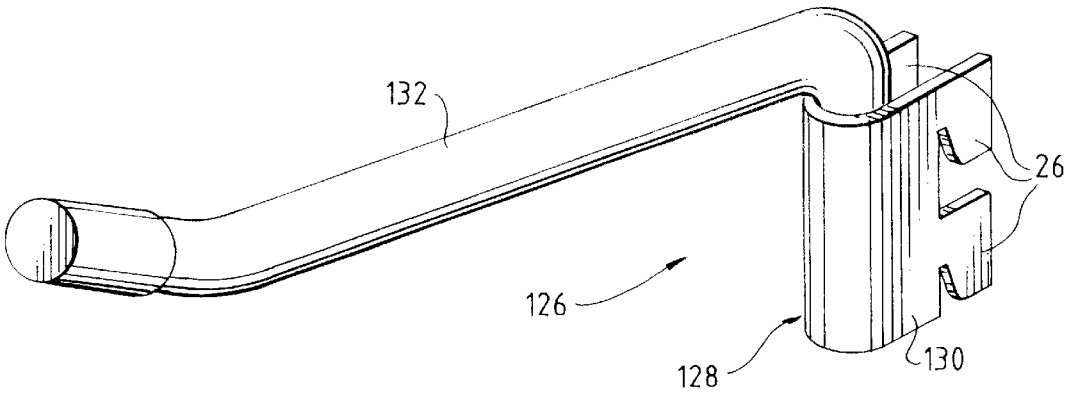

The attachment 126 illustrated in FIG. 18 also includes a generally U-shaped mounting portion 128 having a pair of laterally spaced side legs 130, each having a pair of vertically spaced hook portions 26 at the rear thereof. A support rod 132 extends outwardly from between the side legs 130 of the U-shaped mounting portion 128, with the support rod configured to receive an article thereon for storage.

Figure 19:
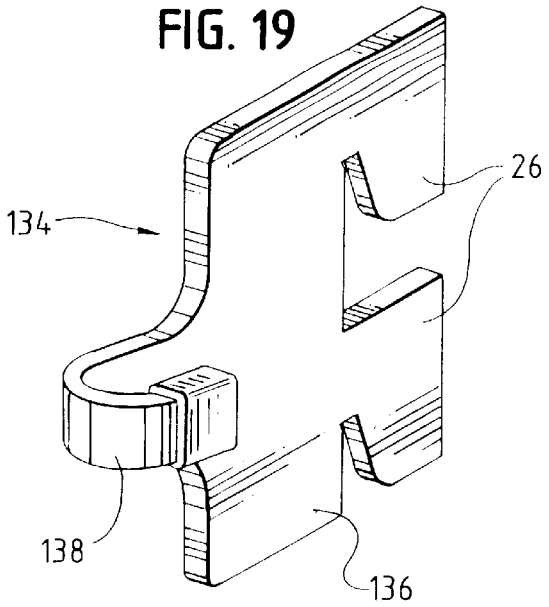
FIG. 19 illustrates an attachment including a rear plate portion, and a support arm extending outwardly therefrom.
Figure 21:
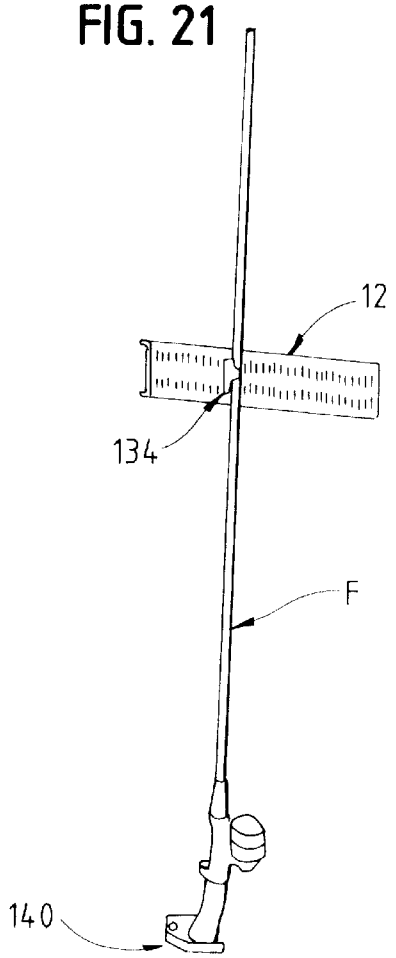
FIG. 21 illustrates use of the attachment shown in FIG. 19, and the support tray illustrated in FIG. 20, positioned to cooperate for support of a fishing rod or like elongated article.
Figure 20:
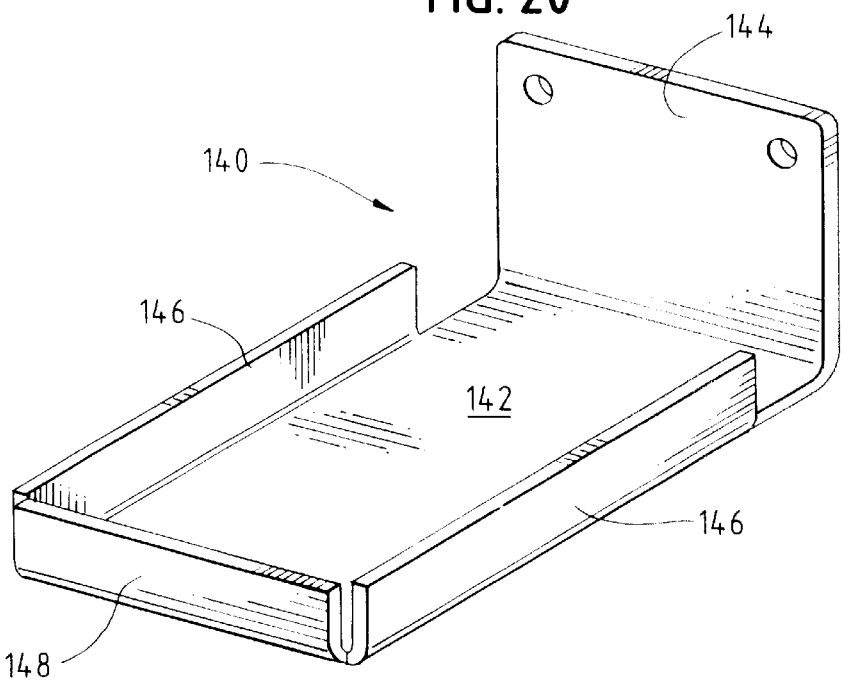
FIG. 20 illustrates a support tray.

FIG. 19 illustrates an attachment 134 which comprises a rear plate portion 136 having a pair of vertically spaced hook-elements 26 at the rear thereof. The attachment 134 further includes a support arm 138 extending outwardly from the rear plate portion 136. In this embodiment, the support arm 138 is generally hook-shaped, and is configured for receiving an elongated article therein. In particular, the attachment 134 is intended to cooperate with a support tray 140, illustrated in FIG. 20. The support tray 140 is preferably of one-piece construction, including a floor 142, a rearward mounting flange 144, a pair of upwardly extending side walls 146, and a front wall 148. As illustrated in FIG. 21, in use, the support tray 140 is positionable beneath mounting channel 12 in order to support an elongated article thereon, such as fishing rod F. The upper portion of the elongated article is retained by the support arm 138 of the attachment 134, thus further enhancing the versatility of the present storage system.

Figure 22:
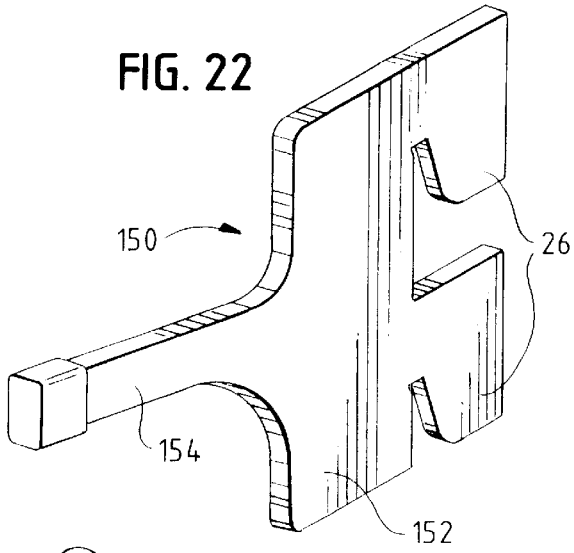
FIG. 22 illustrates a further embodiment of an attachment including a rear plate portion and a support arm extending outwardly therefrom.

FIG. 22 illustrates an attachment 150 which, like attachment 134, includes a rear plate portion 152 having a pair of vertically spaced hook-elements 26 at the rear thereof. The attachment 150 includes a support arm 154 extending outwardly from the rear plate portion 152 for receiving articles thereon.

Figure 23:
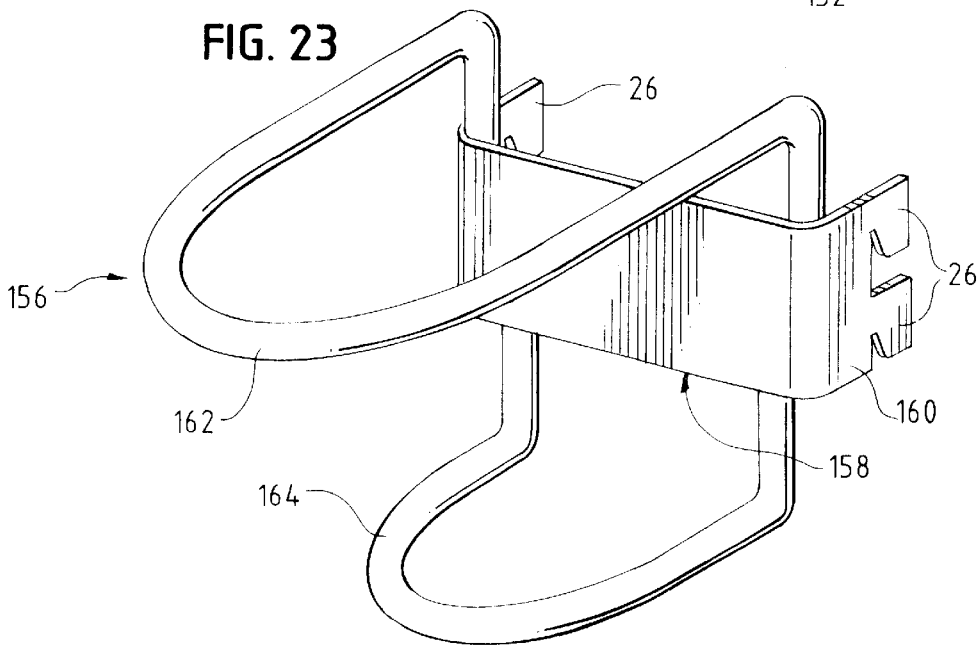

FIG. 23 illustrates an attachment 156 particularly configured for receiving a power tool, such as an electric drill. The attachment 156 includes a generally U-shaped mounting portion 158 having a pair of laterally spaced side legs 160, each of which includes a pair of vertically spaced hook-elements 26 at the rear thereof The attachment 156 includes a pair of vertically-spaced, upper and lower U-shaped support rods 162, 164 respectively extending outwardly from above and below the U-shaped mounting portion 158. In the preferred embodiment, the upper support rod 162 defines an interior dimension that is somewhat larger than an interior dimension defined by the lower support rod 126, whereby an electric drill or like power tool can be received in the attachment by insertion of the chuck portion of the drill downwardly through the upper support rod 162 so that it is received generally within the lower support rod 164. The handle of the electric drill or like tool thus projects generally upwardly and outwardly for convenient use.

Figure 24:
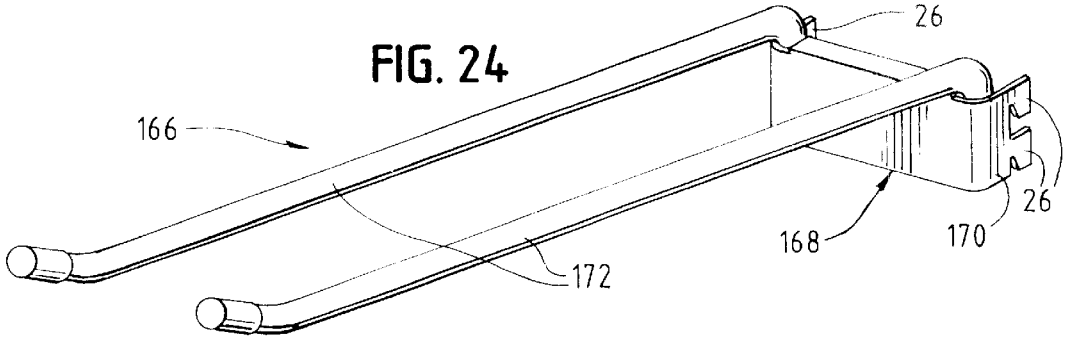
FIG. 24 illustrates an attachment including a pair of laterally spaced support rods.

Attachment 166 illustrated in FIG. 24 also comprises a generally U-shaped mounting portion, designated 168, including a pair of laterally spaced side legs 170, each of which has a pair of vertically-spaced hook elements 126 at the rear thereof. The attachment 166 includes a pair of laterally spaced support rods 172 extending outwardly from between the side legs of the U-shaped mounting portion 168. The support rods 172 may be formed unitarily, i.e., from the same rod element, for ease of manufacture and stability. Rakes, shovels, or like tools can be supported between and upon the pair of laterally spaced support rods 172, with the handles of such tools extending downwardly from between the support rods.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover by the appended claims all such modifications as fall within the scope of the claims.

What is claimed is:

1. A wall-mounted storage system, comprising:

an elongated mounting channel having a generally U-shaped cross-section, including upper and lower leg portions, and a forwardly facing web portion extending between said leg portions;

said web portion defining upper and lower rows of laterally spaced hook-receiving openings, each of said hook-receiving openings being generally vertically elongated, with respective ones of said openings of said upper and lower rows being vertically aligned with each other; and a plurality of storage attachments selectively, removably positionable on said mounting channel, each of said attachments including at least one pair of vertically spaced, vertically aligned, downwardly opening hook-elements, each of said hook-elements defining an upwardly converging opening, whereby each pair of hook-elements of each of said attachments can be selectively, respectively positioned in a respective pair of vertically aligned ones of said hook-receiving openings in said upper and lower rows of openings in said mounting channel, said upwardly converging opening of each said hook element being shaped to resiliently deform said web portion of said mounting channel beneath the respective one of said hook openings, when said web is received within said upwardly converging opening, to provide a stable mounting of the attachments on the mounting channel.

2. A wall-mounted storage system in accordance with claim 1, wherein:

at least said upper leg portion of said mounting channel defines a plurality of laterally spaced article-receiving openings.

3. A wall-mounted storage system in accordance with claim 2, wherein:

said storage system including at least one generally U-shaped wire rack having a pair of laterally spaced free ends at the rear thereof, said free ends being insertible in a laterally spaced pair of said article-receiving openings for removably mounting said wire rack on said mounting channel.

4. A wall-mounted storage system in accordance with claim 1, wherein:

one of said attachments comprises an outwardly positioned rack extension, comprising a vertical plate portion having one of said pairs of said vertically-spaced hook-elements at the rear thereof, and a horizontal plate portion extending from said vertical plate portion, and defining a plurality of spaced apart openings for receiving articles therein.

5. A wall-mounted storage system in accordance with claim 4, wherein:

said one of said attachments includes a laterally spaced pair of said vertical plate portions between which said horizontal plate portion extends, said vertical plate portions each defining a plurality of spaced apart article-receiving openings.

6. A wall-mounted storage system in accordance with claim 1, wherein:

at least one of said attachments comprises a generally U-shaped mounting portion having a pair of laterally spaced side legs, each of which has a pair of said vertically-spaced hook-elements at the rear thereof.

7. A wall-mounted storage system in accordance with claim 6, wherein:

said one of said attachments comprises a magnetic mounting element secured to the front of said U-shaped mounting portion.

8. A wall-mounted storage system in accordance with claim 6, wherein:

said one of said attachments comprises a support rod extending outwardly from between the side legs of said U-shaped mounting portion.

9. A wall-mounted storage system in accordance with claim 6, wherein:

said one of said attachments comprises a pair of laterally spaced support rods extending outwardly from between the side legs of said U-shaped mounting portion.

10. A wall-mounted storage system in accordance with claim 6, wherein:

said one of said attachments comprises vertically-spaced, upper and lower U-shaped support rods respectively extending outwardly from above and below said U-shaped mounting portion, said upper U-shaped support rod defining an interior dimension larger than an interior dimension defined by said lower U-shaped support rod.

11. A wall-mounted storage system in accordance with claim 6, wherein said one of said attachments includes a generally U-shaped support rod pivotally attached to said U-shaped mounting portion.

12. A wall-mounted storage system in accordance with claim 1, wherein:

one of said attachments comprises a rear plate portion having said pair of vertically-spaced hook-elements at the rear thereof, and a support arm extending outwardly from said rear plate portion.

13. A wall-mounted storage system in accordance with claim 12, wherein:

said storage system includes a support tray positionable beneath said mounting channel to support an elongated article thereon, with an upper portion of said article retained by said support arm of said one of said attachments.

14. A wall-mounted storage system in accordance with claim 1, wherein:

one of said attachments comprises a one-piece storage compartment, comprising a pair of laterally spaced sidewalls each of which include a pair of said vertically-spaced hook-elements at the rear thereof, said storage compartment further comprising a floor extending integrally between said sidewalls, a front wall extending integrally from said floor, and a rear wall extending integrally from said floor.

15. A wall-mounted storage system in accordance with claim 1, wherein:

one of said attachments comprises a shelf support bracket, comprising a vertical plate portion having said pair of vertically-spaced hook-elements at the rear thereof, said vertical plate portion including upper and lower rearward extensions respectively positioned above and below said hook-elements for respective positioning above and below said mounting channel when said shelf support bracket is mounted on said mounting channel, said shelf support bracket further including horizontal support flange at an upper edge of said vertical plate portion, whereby an associated shelf member can be positioned on top of the horizontal flanges of a laterally spaced pair of said shelf support brackets mounted on said mounting channel.

16. A wall-mounted storage system in accordance with claim 1, wherein:

one of said attachments comprises a one-piece tool hanger having a pair of laterally spaced side plates each of which has a pair of said vertically-spaced hook-elements at the rear thereof, and an upper plate extending integrally between said side plates, said upper plate defining a forwardly opening recess for receiving an associated tool therein for mounting of said storage system.

17. A wall-mounted storage system comprising:

an elongated mounting channel having a generally U-shaped cross-section, including upper and lower leg portions, and a forwardly facing web portion extending between said leg portions;

said web portion defining at least one row of laterally spaced hook-receiving openings, each of said hook-receiving openings being generally vertically elongated; and a plurality of storage attachments selectively, removably positionable on said mounting channel, each of said attachments including at least one pair of laterally spaced, downwardly opening hook elements, each of said hook-elements defining an upwardly converging opening, whereby each pair of hook-elements of each said attachments can be selectively, respectively positioned in a respective pair of laterally spaced ones of said hook-receiving openings in said at least one row of openings in said mounting channel, said upwardly converging opening of each said hook element being shaped to resiliently deform said web portion of said mounting channel beneath the respective one of said hook openings, when said web is received within said upwardly converging opening, to provide stable mounting of the attachments on the mounting channel.

18. A wall-mounted storage system in accordance with claim 17, wherein:

at least one of said attachments comprises a generally U-shaped mounting portion having a pair of laterally spaced side legs, each of which has one of said vertically-spaced hook-elements at the rear thereof.

19. A wall-mounted storage system in accordance with claim 18, wherein:

said one of said attachments comprises a support rod extending outwardly from between the side legs of said U-shaped mounting portion.

20. A wall-mounted storage system in accordance with claim 17, wherein:

said one of said attachments includes a laterally spaced pair of vertical plate portions between which a horizontal plate portion extends, said vertical plate portions each having one of said hook-elements at the rear thereof and defining a plurality of spaced apart article-receiving openings.

21. A wall-mounted storage system in accordance with claim 17, wherein:

one of said attachments comprises a one-piece storage compartment, comprising a pair of laterally spaced sidewalls each of which include one of said hook-elements at the rear thereof, said storage compartment further comprising a floor extending integrally between said sidewalls, a front wall extending integrally from said floor, and a rear wall extending integrally from said floor.

22. A wall-mounted storage system in accordance with claim 17, wherein:

one of said attachments comprises a shelf support bracket comprising a vertical plate portion having one of said hook-elements at the rear thereof, said vertical plate portion including upper and lower rearward extensions respectively positioned above and below said hook-element for respective positioning above and below said mounting channel when said shelf support bracket is mounted on said mounting channel, said shelf support bracket further including a horizontal support flange at an upper edge of said vertical plate portion, whereby an associated shelf member can be positioned on top of the horizontal flanges of a laterally spaced pair of said shelf support brackets mounted on said mounting channel.

23. A wall-mounted storage system in accordance with claim 17, wherein:

one of said attachments comprises a one-piece tool hanger having a pair of laterally spaced side plates each of which has one of said hook-elements at the rear thereof, and an upper plate extending integrally between said side plates, said upper plate defining a forwardly opening recess for receiving an associated tool therein for mounting of said storage system.

* * * * *